US006494422B2

(12) United States Patent
Sauer et al.

(10) Patent No.: US 6,494,422 B2
(45) Date of Patent: Dec. 17, 2002

(54) LENGTH ADJUSTABLE COLUMN WITH AXIAL BEARING, AND METHOD OF INSTALLATION OF THE AXIAL BEARING

(75) Inventors: Rainer Sauer, Mayen (DE); Reiner Weber, Wiltingen (DE)

(73) Assignee: Stabilus GmbH, Koblenz (DE)

( * ) Notice: Subject to any disclaimer, the term of this patent is extended or adjusted under 35 U.S.C. 154(b) by 0 days.

(21) Appl. No.: 09/788,185

(22) Filed: Feb. 16, 2001

(65) Prior Publication Data

US 2001/0025906 A1 Oct. 4, 2001

(30) Foreign Application Priority Data

Feb. 16, 2000 (DE) ..... 100 06 884

(51) Int. Cl.[7] ..... F16M 11/00
(52) U.S. Cl. ..... 248/162.1; 248/161; 248/631
(58) Field of Search ..... 248/162.1, 631, 248/161, 909, 157, 519, 188.1, 188.7

(56) References Cited

U.S. PATENT DOCUMENTS

| | | | | |
|---|---|---|---|---|
| 4,720,068 A | * | 1/1988 | Tornero | 248/161 |
| 4,729,458 A | | 3/1988 | Bauer et al. | |
| 5,078,351 A | * | 1/1992 | Gualtieri | 248/161 |
| 5,120,011 A | | 6/1992 | Mintgen et al. | |
| 5,740,997 A | * | 4/1998 | Van Wieran | 248/404 |
| 5,988,605 A | * | 11/1999 | Weisser et al. | 267/64.12 |
| 6,007,044 A | | 12/1999 | Harrer | |
| 6,199,806 B1 | * | 3/2001 | Sauer et al. | 248/161 |

FOREIGN PATENT DOCUMENTS

| | | |
|---|---|---|
| DE | 1961656 | 6/1968 |
| DE | 6753661 | 6/1968 |
| DE | 1 779 813 | 2/1973 |
| DE | 21 64 196 | 5/1975 |
| EP | 0 366 889 | 11/1993 |
| EP | 0 477 617 | 11/1994 |
| FR | 2022207 | 7/1970 |
| GB | 1239729 | 7/1971 |

* cited by examiner

*Primary Examiner*—Anita King
(74) *Attorney, Agent, or Firm*—Cohen, Potani, Lieberman & Pavane

(57) ABSTRACT

A length-adjustable column for chairs or the like comprises an upright tube with a longitudinal axis and a piston-and-cylinder unit radially supported and displaceably guided in the direction of the longitudinal axis. A lengthwise end of the piston-and-cylinder unit is locked by an axial bearing on a base plate of the upright tube in the axial direction. For this purpose, the axial bearing is axially fixed to the lengthwise end of the piston-and-cylinder unit. The axial bearing has at least two locking arms which lock it to the base plate of the upright tube, and a securing bolt which is pushed by the piston-and-cylinder unit between the locking arms to secure the locking.

22 Claims, 4 Drawing Sheets

LENGTH ADJUSTABLE COLUMN WITH AXIAL BEARING, AND METHOD OF INSTALLATION OF THE AXIAL BEARING

BACKGROUND OF THE INVENTION

1. Field of the Invention

The invention relates to a length-adjustable column for chairs or the like, comprising an upright tube with a longitudinal axis, and a piston-and-cylinder unit received in the upright tube. A first lengthwise end of the piston-and-cylinder unit being radially supported in the upright tube and displaceably guided in the direction of the longitudinal axis, while a second lengthwise end of the piston-and-cylinder unit is locked in the axial direction by means of an axial bearing on a base plate of the upright tube having an aperture. The bearing is on the one hand fixedly connected in the axial direction to the second lengthwise end of the piston-and-cylinder unit, and on the other hand, formed with a latching arrangement which fixes the axial bearing in the axial direction on the upright tube by engagement into the aperture of its base plate.

2. Description of the Related Art

The axial bearings of such length-adjustable columns have, as indicated above, the function of fixedly connecting the second lengthwise end of the piston-and-cylinder unit to the upright tube in the direction of the longitudinal axis of the upright tube. However, it is generally desirable, especially in length-adjustable columns for swivel chairs, for the piston-and-cylinder unit to be able to rotate about the longitudinal axis of the upright tube despite being fixed in the axial direction in the upright tube. Customarily, this possibility of rotation is likewise provided by the axial bearing, or more accurately by its connection to the second lengthwise end of the piston-and-cylinder unit and/or its connection to the base plate of the upright tube.

U.S. Pat. No. 6,007,044 discloses a generic, length-adjustable column with such an axial bearing. The axial bearing, formed as an injection molding, has a fixing pin at its lower end which is intended to engage into the aperture in the base of the upright tube. The outer diameter of this fixing pin is, at its widest point, less than the inner diameter of the aperture in the base plate. A spreader ring with a frustoconical outer circumferential surface is inserted into an annular groove in the fixing pin. In its relaxed state, the spreader ring has an outer diameter that is greater than the inner diameter of the aperure of the base of the upright tube. However, when the fixing pin is introduced into that aperture, the spreader ring can be compressed to a diameter which is less than the inner diameter of the aperture of the base plate of the upright tube. If the fixing pin has passed completely through the aperture, the spreader ring expands again as a result of its intrinsic elasticity, engages behind the aperture and thus secures the axial bearing on the base plate. A disadvantage of this embodiment is that the fixing pin and the spreader ring have to be produced to close tolerances in order to be able to ensure firm seating of the axial bearing on the base plate. As a result of these narrow tolerances, however, it may occur during installation of the axial bearing that the spreader ring, after the introduction of the fixing pin into the base plate aperture, does not re-expand to the necessary extent because of excessive friction. As a result, in the event of the exertion of upward-directed axial forces away from the base plate, the axial bearing may again becomes detached from the base plate.

U.S. Pat No. 5,120,011 discloses an axial bearing, formed as a rolling contact bearing, with a cage which passes through the base of the upright tube and is locked to the piston rod. DE 21 64 196 C3 discloses a sliding bearing which is elastically locked to the piston rod. U.S. Pat. No. 4,729,458 discloses securing the locking of the piston-and-cylinder unit on the base of the upright tube by means of a separate pin introduced from below.

Additional prior art that may be mentioned for the sake of completeness includes GB 1 239 729 A, EP 0 477 617 B1, EP 0 366 889 B1, DE 1 961 656, DE-GM 67 53 661, DE-C 1 779 813 and FR 2 022 207 A.

SUMMARY OF THE INVENTION

By comparison with the above, it is an object of the invention to provide a length-adjustable column of the type mentioned initially which offers increased security against unintentional releasing of the axial bearing from the base plate of the upright tube of the column.

According to the invention, the latching arrangement has at least two locking arms and a securing bolt, the securing bolt being insertable between the locking arms in the course of production of the axially fixed connection between the axial bearing and the second lengthwise end of the piston-and-cylinder unit from this second lengthwise end of the piston-and-cylinder unit and thus securing the locking of the latching arrangement in the aperture of the base plate of the upright tube. In its position inserted between the locking arms, the securing bolt prevents the arms from moving toward one another, for example under the influence of external forces, and thus ensures that the axial bearing remains securely locked in the aperture of the base plate.

The securing bolt can be integrally molded on the axial bearing, preferably on a base disk of the axial bearing intended to rest on the base plate of the upright tube. This embodiment has the advantage that, in order to provide the complete axial bearing including all parts of the latching arrangement, only a single part needs to be manufactured. This part combines all the functions required of the axial bearing including the securing of the latching arrangement against unintentional release from the base of the upright tube. As a result of this design, moreover, preassembly steps for the axial bearing, as required for example in the axial bearing known from U.S. Pat. No. 6,007,044 in which the spreader ring has to be plug-fitted onto the fixing pin in a preassembly step, become unnecessary.

In order to enable the securing bolt to be inserted between the locking arms, in a further development of this embodiment, the securing bolt can be connected to the axial bearing, preferably the base disk thereof, via at least one predetermined breaking point. The predetermined breaking point here can be formed by a web of material connecting the securing bolt to the axial bearing, preferably the base disk thereof, and/or by a strip of material extending over at least part of the circumference of the securing bolt and connecting the securing bolt to the axial bearing, preferably the base disk thereof.

In order to prevent the securing bolt obstructing the insertion of the latching arrangement into the aperture in the base of the upright tube, it is further proposed that the securing bolt be arranged, in a ready-to-fit state of the axial bearing, substantially completely outside the area between the locking arms.

The locking arms may be designed in various ways: for example, at least one of the locking arms can be elastically lockable to the base plate of the upright tube. In addition, or alternatively, it is also possible for the locking arms to be spread as a result of the insertion of the securing bolt.

In order to be able to prevent unintentional dropping of the securing bolt out of the area between the locking arms, the latching arrangement may have at least one axial stop for the securing bolt. This at least one axial stop may, for example, be formed by at least one shoulder on at least one of the locking arms. In addition, or alternatively, the securing bolt may have at least one lengthwise groove which is open at its end nearer the locking arm and closed at its end further from the locking arm in the direction of the longitudinal axis, and the axial bearing has at least one shoulder which engages into an assigned lengthwise groove.

For axially fixing the axial bearing on the second lengthwise end of the piston-and-cylinder unit, the axial bearing, preferably the base disk thereof, can be provided in a conventional manner with a snap-engagement arrangement. According to a structurally simple embodiment, this snap-engagement arrangement may have at least one snapping arm. To retain the second lengthwise end of the piston-and-cylinder unit, this at least one snapping arm may have a locking surface which is, for example, substantially trapezoidal in section and intended to engage into a locking recess provided on the circumference of the second lengthwise end of the piston-and-cylinder unit. In order to be able to provide a connection between the axial bearing and the piston-and-cylinder unit in the direction of the axis of the upright tube which is firm but allows twisting about that axis, the locking recess on the circumference of the second lengthwise end of the piston-and-cylinder unit can be a locking groove extending over the entire circumference.

To facilitate installation of the piston-and-cylinder unit into the upright tube, it is also proposed that the axial bearing comprise a cage to receive, preferably with a friction fit, the second lengthwise end of the piston-and-cylinder unit. This is because the cage makes it possible for the axial bearing to be plug-fitted onto the second lengthwise end of the piston-and-cylinder unit and introduced into the upright tube together with the latter. Thus, no elaborate preassembly of the axial bearing in the aperture of the base of the upright tube is necessary. Instead, the axial bearing can be installed together with the piston-and-cylinder unit.

The cage may, for example, have a holding ring which is connected to a base disk of the axial bearing via at least one connecting web. At least one elongate projection extending in the axial direction can be provided on an inner surface of the holding ring and/or of the at least one connecting web. This at least one projection serves to rest on the second lengthwise end of the piston-and-cylinder unit and, because of its relatively small contact surface with the latter, prevents the occurrence of excessive frictional forces between piston-and-cylinder unit and axial bearing even when production tolerances are generous.

In principle, it is possible for the at least one above-mentioned snapping arm of the snap-engagement arrangement to start from the base disk of the axial bearing. According to the invention, however, the at least one snapping arm extends from the holding ring toward the base disk.

As is known per se, the second lengthwise end of the piston-and-cylinder unit can be formed by the free end of a piston rod of this piston-and-cylinder unit. In order to be able to prevent the piston rod breaking through the base of the upright tube in the serious event of destruction of the axial bearing, it is proposed that the piston rod have a greater diameter than the aperture in the base of the upright tube.

From another standpoint, the invention relates to an axial bearing having the axial bearing features explained above.

Finally, the invention also relates to a method for installing a piston-and-cylinder unit in an upright tube of a length-adjustable column for chairs or the like, using an axial bearing according to the invention. The installation method according to the invention comprises the following steps:

plug-fitting the axial bearing with its cage onto the second lengthwise end of the piston-and-cylinder unit, introducing the piston-and-cylinder unit preassembled in this way into the upright tube with the second lengthwise end foremost, exerting a first axial installing force on the piston-and-cylinder unit, which is sufficient to introduce the latching arrangement sufficiently far into the aperture in the base plate of the upright tube for the axial bearing to rest on the base plate, and exerting a second axial installing force on the piston-and-cylinder unit which is greater than the first installing force and which is sufficient to introduce the securing bolt between the locking arms of the latching arrangement.

Advantageously, the second axial installation force can be such as to suffice to destroy the predetermined breaking points by means of which the securing bolt is retained on the axial bearing.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
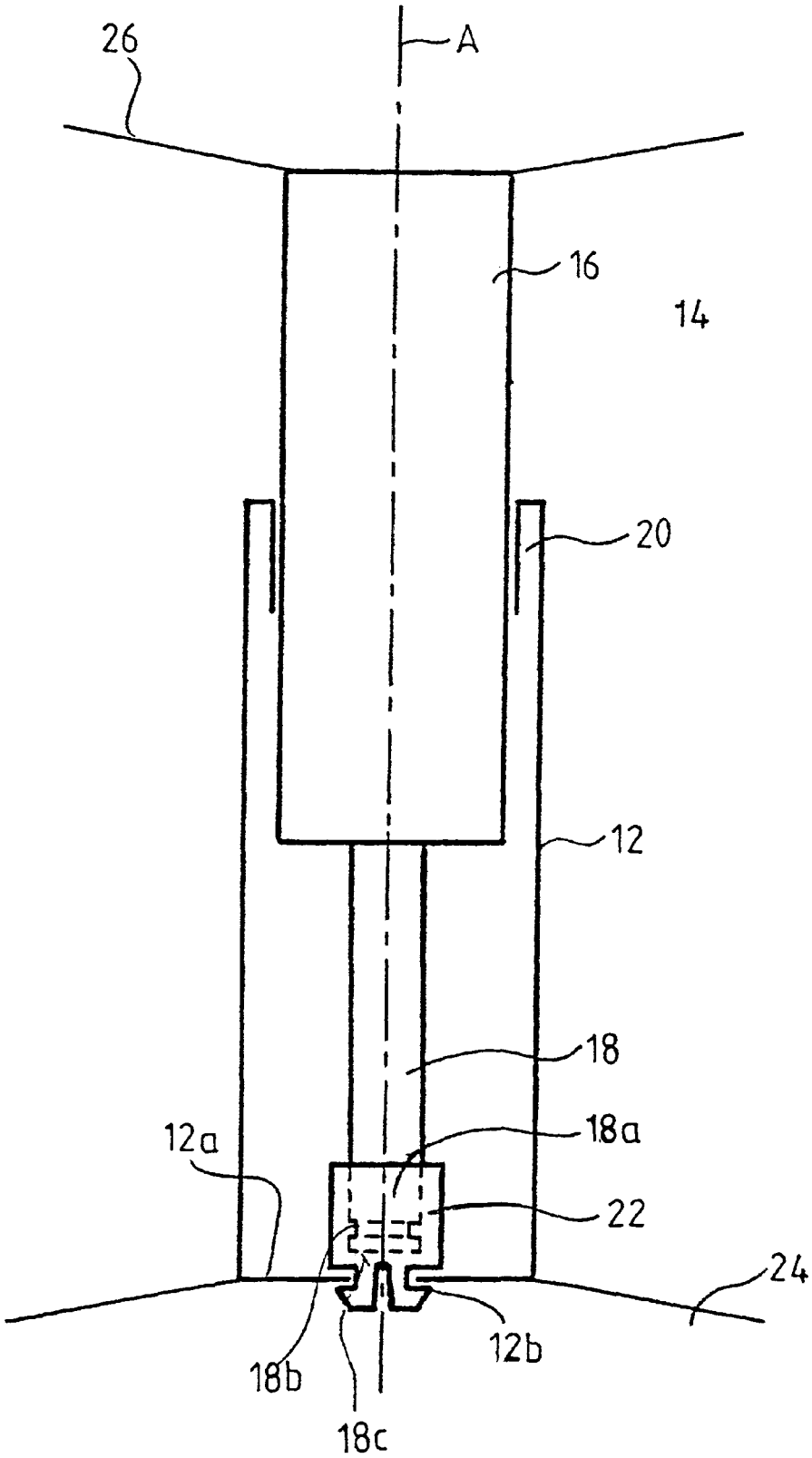
FIG. 1 shows a roughly diagrammatic lateral view of a length-adjustable column according to the invention with the upright tube cut open.

In FIG. 1, a length-adjustable column 10 includes an upright tube 12, shown roughly diagrammatically in section, and a pneumatic, hydraulic or hydropneumatic piston-and-cylinder unit 14 with a cylinder 16, a piston rod 18 and a piston connected to the piston rod 18 and guided in the cylinder 16 but not shown separately in FIG. 1. The cylinder 16 is radially supported at sleeve 20 in the upright tube 12, but guided to be axially displaceable in the direction of the longitudinal axis A. The free end 18*a* of the piston rod 18 is axially fixed by means of an axial bearing 22 in an aperture 12*b* of a base plate 12*a* of the upright tube 12, but is twistable relative to the upright tube 12 about its axis A.

The lower end of the length-adjustable column 10 is adjoined by a foot arrangement 24 of a chair, for example an office swivel chair. This foot arrangement 24 is merely indicated by two lines in FIG. 1. In a similar manner, a seating surface arrangement 26 of the chair adjoins the upper end of the column 10, and is again only indicated by two lines in FIG. 1. By means of an actuating mechanism (not shown), a valve provided in the piston-and-cylinder unit 14, preferably in the piston thereof, can be optionally opened or closed in a manner known per se, so that the length of the column 10 and hence the height of the seating surface arrangement 26 above the floor can be set as required.

Figure 2:
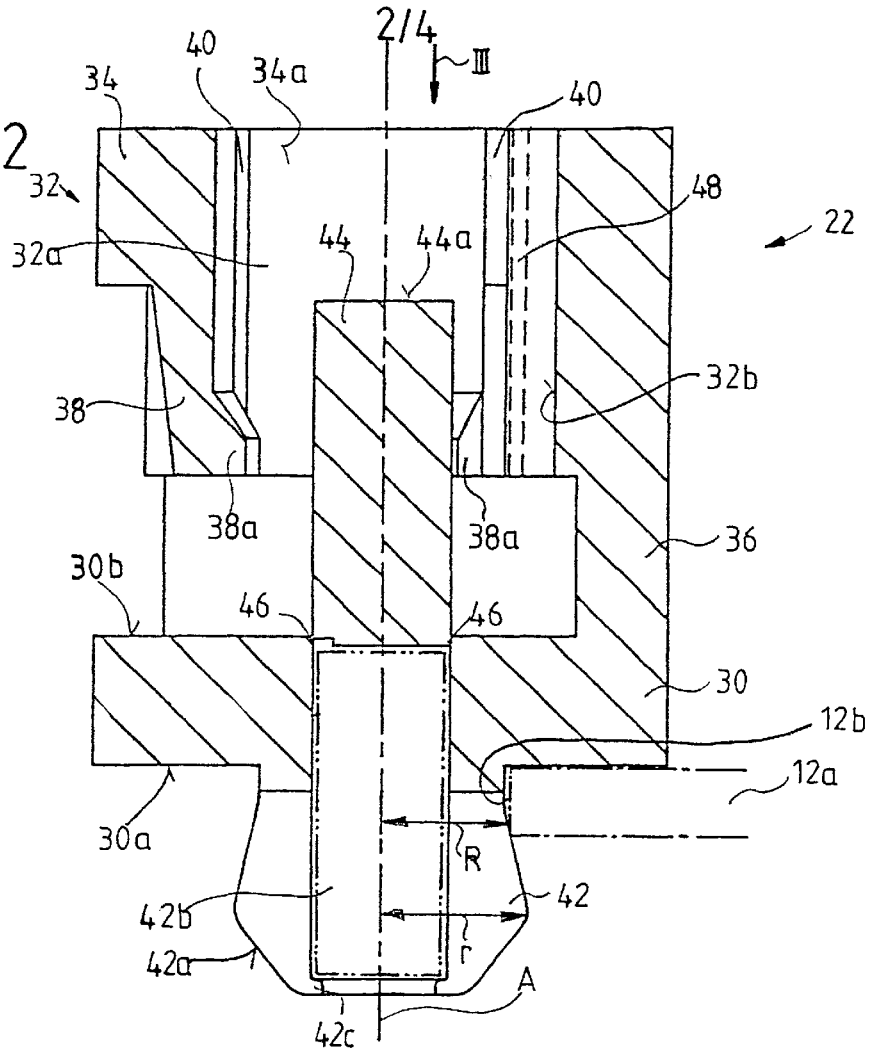
FIG. 2 shows an enlarged sectional view of a first embodiment of an axial bearing according to the invention.
Figure 3:
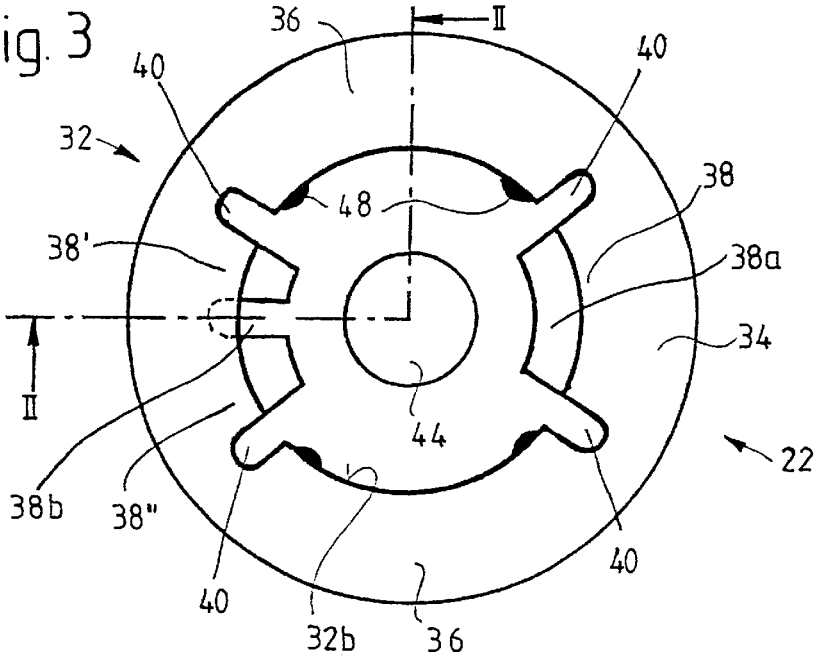
FIG. 3 shows a plan view of the axial bearing according to FIG. 2 in the direction of the arrow III FIG. 2.

With reference to FIGS. 2 and 3, a first embodiment of an axial bearing 22 formed in accordance with the invention will be described in detail below.

The axial bearing 22 is produced as an integrally formed plastic injection molding having a base disk 30, whose under-surface 30*a* is intended to rest on the base plate 12*a* of the upright tube 12. A cage 32 is provided on the opposite, upper surface 30*b* of the base disk 30 and serves to receive the free end 18*a* of the piston rod 18 with a friction fit. The cage 32 comprises a holding ring 34 with a central aperture 34*a* and two vertical webs 36 which connect the holding ring 34 to the base disk 30. The holding ring 34 also serves, in the event of a contraction of the piston-and-cylinder unit 14, as a stop for the cylinder 16.

Two snapping arms 38 are formed between the vertical webs 36 and project downward from the holding ring 34 toward the base disk 30. A locking shoulder 38*a* is provided on the lower end of each of the snapping arms 38 and is intended to engage into a locking groove 18*b* (see FIG. 1) of the piston rod 18. As a result of vertical perforations 40, which border on the connecting webs 36 in the holding ring 34, the snapping arms 38 have sufficient elasticity to be able to be deflected radially outward in the cage 32 when the free end 18*a* of the piston rod 18 is inserted and then to snap back again, because of their intrinsic elasticity, radially inward into the circumferential groove 18*b* of the piston rod 18 and thus fix this piston rod in the axial direction on the axial bearing 22. As is indicated in the left-hand half of FIG. 3, the snapping arms 38 can be divided by a slit 38*b* extending in the axial direction. In this manner, two partial snapping arms 38' and 38" are obtained, which have an even higher elasticity.

A plurality of locking arms 42, for example four, are provided on the under-surface 30*a* of the base disk 30 and serve to lock the axial bearing 22 in the aperture 12*b* in the base plate 12*a* of the upright tube 12. In the embodiment shown in FIG. 2, the maximum radius r of the locking arms 42 is greater in size than the radius R of the aperture 12*b*. As a consequence, the locking arms 42, when introduced into the aperture 12*b*, are radially compressed as a result of the interaction of their outer circumferential surface, formed in part as an entry ramp 42*a*, with the surround of the aperture 12*b* of the base 12*a* of the upright tube. After they have passed the aperture 12*b*, the locking arms, because of their resilience, move apart again radially and so fix the axial bearing 22 in the aperture 12*b* of the base 12*a* of the upright tube in the axial direction A.

Since the locking arms 42 engage behind the circumferential edge of the aperture 12*b* of base 12 as a result of their resilience without the influence of external forces, they are not pure locking members but, rather, snapping members in the same sense as the snapping arms 38.

Finally, the axial bearing 22 also comprises a securing bolt 44, which is integrally molded onto the base disk 30 on the side of the upper surface 30*b* in the area of the axis A and thus projects into the interior space 32*a* of the cage 32. As is shown in FIG. 2, the securing bolt 44 is connected to the base disk 30 only via thin webs 46 of material. These webs 46 can either be provided only at separate, for example, two, points on the circumference of the securing bolt 44 or can extend as a thin "film" over at least part of the circumference of the securing bolt. The webs 46 are frangible webs, that is, they are easily broken when a downward axial force is exerted on the securing bolt 44, so that the securing bolt 44 can be displaced downward through the central aperture 30*c* of the base disk 30 into the area 42*b* between the locking arms 42. In its downward-displaced position, shown in FIG. 2 by dot-and-dash lines, the securing bolt 44 prevents the locking arms 42 shifting radially inward under the influence of external forces and thus prevents an unintentional disengagement of axial bearing 22 and base 12*a* of the upright tube.

It should further be added that shoulders 42*c* are provided at the lower end of the locking arms 42 and prevent, by positive fitting, the securing bolt 44 from dropping out of the area 42*b* between the locking arms 42. An upward movement of the securing bolt 44 is impossible because of the piston rod 18.

The outer diameter of the piston rod 18 is greater than the inner diameter of the aperture 12*b* of the base 12*a* of the upright tube. This ensures that, in the serious event of destruction of the axial bearing 22, the piston rod 18 cannot readily penetrate the base 12*a* through aperture 12*b*.

Vertical beads 48 are provided on the inner circumferential surface 32*b* of the cage 32 to ensure not only that the piston rod 18 can be received with a friction fit in the cage 32 of the axial bearing 22, but also that these frictional forces, in the event of a relatively high production tolerance, cannot take on excessive values. In addition, the beads 48 facilitate the centering of the piston rod 18 when it is introduced into the cage 32.

The axial bearing 22 according to the invention implements all functions, including the securing of locking to the base 12*a* of the upright tube, in a single, easily produced part, which first permits simplified storage and secondly makes any preassembly of the axial bearing unnecessary. In addition, the installation of the piston-and-cylinder unit 14 in the upright tube 12, using the axial bearing 22 according to the invention, is extremely simple.

First, the axial bearing 22 is plug-fitted onto the free end 18*a* of the piston rod 18 until the piston rod 18 rests by its end surface 18*c* (see FIG. 1) on the end surface 44*a* (see FIG. 2) of the securing bolt 44. The piston-and-cylinder unit 14 is then introduced into the upright tube 12 with the axial bearing 22 foremost, until the locking arms 42 rest on the edge of the aperture 12*b* of the base 12*a* of the upright tube.

A first axial installing force is now exerted on the piston-and-cylinder unit 14 and is sufficiently great to compress the locking arms 42 radially, as a result of the interaction of their entry ramps 42*a* with the circumferential rim of the aperture 12*b*, until the locking arms 42 pass through the aperture 12*b* and are eventually able to lock the axial bearing 22 on the base 12*a* of the upright tube. In this state, the under-surface 30*a* of the base disk 30 of the axial bearing 22 lies on the base 12*a* of the upright tube.

By means of a second axial installation force, which is greater than the first installation force, the frangible webs 46 are now broken as a result of the contact of the end surfaces 18*c* of the piston rod 18 and 44*a* of the securing bolt 44, and the securing bolt 44 is shifted downward by the piston rod 18 into the area 42*b* between the locking arms 42, until the piston rod 18 rests on the upper surface 30*b* of the base disk 30 of the axial bearing 22. In the course of this downward movement of the piston rod 18 in the cage 32, the snapping arms 38 are pressed radially outward until, toward the end of this movement, they can snap into the circumferential groove 18*b* of the piston rod 18.

In this state, first, the piston rod 18 is fixed in the axial direction by means of the snap engagement of arms 38 in groove 18*b* on the axial bearing; relative twistability of axial bearing 22 and piston rod 18 about the axis A is ensured by the groove 18*b* extending about the entire circumference of the piston rod 18. Secondly, the axial bearing 22 is locked on the base 12*a* of the upright tube and this locking is secured by the securing bolt 44, so that an unintentional, automatic release of this locking is not possible.

The piston rod 18 bears, with a relatively large proportion of its end surface 18*c*, on the upper surface 30*b* of the base disk 30 and, to some extent, also by the end surface 44*a* of the securing bolt 44 and the retaining shoulders 42*c* of the locking arms 42, on the axial bearing 22. As a result, the surface pressure exerted on the plastic material of the axial bearing 22 is reduced, so that the axial forces arising in the operation of the length-adjustable column 10 can be passed directly into the plastic part 22. An additional steel disk to distribute the surface pressure forces can thus be dispensed with. As described above, the assembly of the axial bearing on the piston rod and of the piston-and-cylinder unit in the upright tube can take place in a single working operation.

Figure 4:
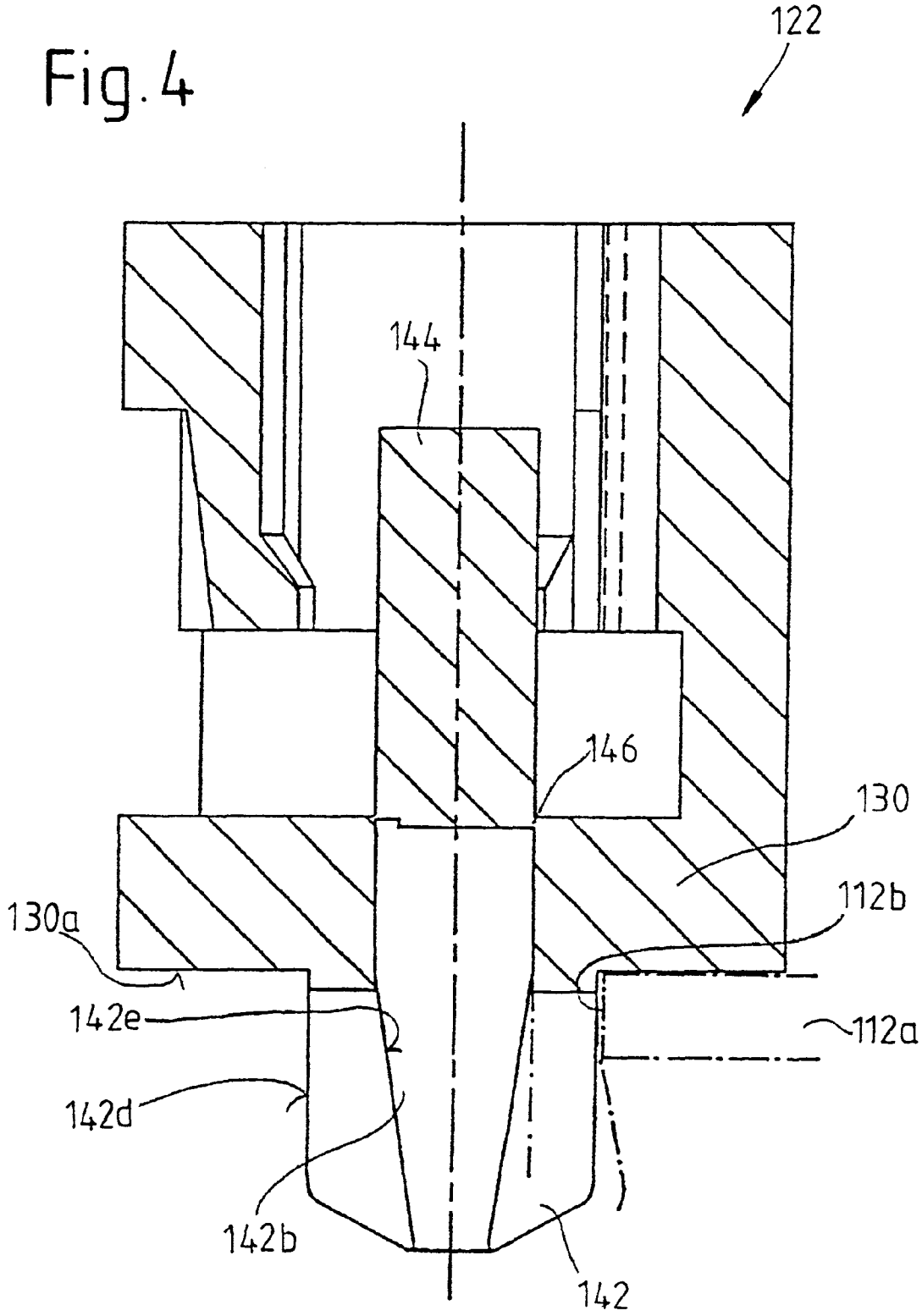
FIG. 4 is an enlarged sectional view of a second embodiment of the axial bearing.

In FIG. 4, similar parts are provided with the same reference numerals as in FIG. 2, but increased by 100. In addition, the axial bearing 122 according to FIG. 4 is described below only in so far as it differs from the axial bearing 22 according to FIG. 2.

The axial bearing 122 according to FIG. 4 differs from the axial bearing 22 according to FIG. 2 exclusively in the form of the locking arms 142, which are formed exclusively as locking members. In other words, they are not snapping members which can pass into the locking position automatically without the application of an external force. Instead, an external force must be exerted to move them into the locking position.

Accordingly, the locking arms 142 have outer circumferential surfaces 142*d* whose encompassing surface is substantially the surface of a circular cylinder whose diameter is less than the diameter of the aperture 112*b* of the base 112*a* of the upright tube. As a result of this configuration, the axial bearing 122, after introduction of the locking arms 142 through the aperture 112*b*, is not yet locked to the base 112*a* of the upright tube but can be readily removed again from the base 112*a* of the upright tube. The encompassing surface of the inner circumferential surfaces 142*e* of the locking arms 142 is, in the example according to FIG. 4, formed to correspond to the surface of a frustum, which tapers from the under-surface 130*a* of the base disk 130 toward the free end of the locking arms 142.

After breaking the frangible webs 146, the securing bolt 144 is pushed by the piston rod into the area 142*b* between inside surfaces 142*e* of the locking arms 142, pressing these locking arms radially outward arms 142, into the position shown in dot-and-dash lines in FIG. 4, in which the locking arms 142 are locked to the base 112*a* of the upright tube.

While not shown in FIG. 4, the locking arms 142 can also be provided with retaining shoulders corresponding to the retaining shoulders 42*c* of the axial bearing according to FIG. 2. However the risk of the securing bolt 144 dropping out from the area 142*b* is not as great as in the embodiment according to FIG. 2, because the locking arms 142, deflected radially outward by the securing bolt 144, hold the securing bolt 144 with a frictional fit, by virtue of their resilience.

Figure 5:
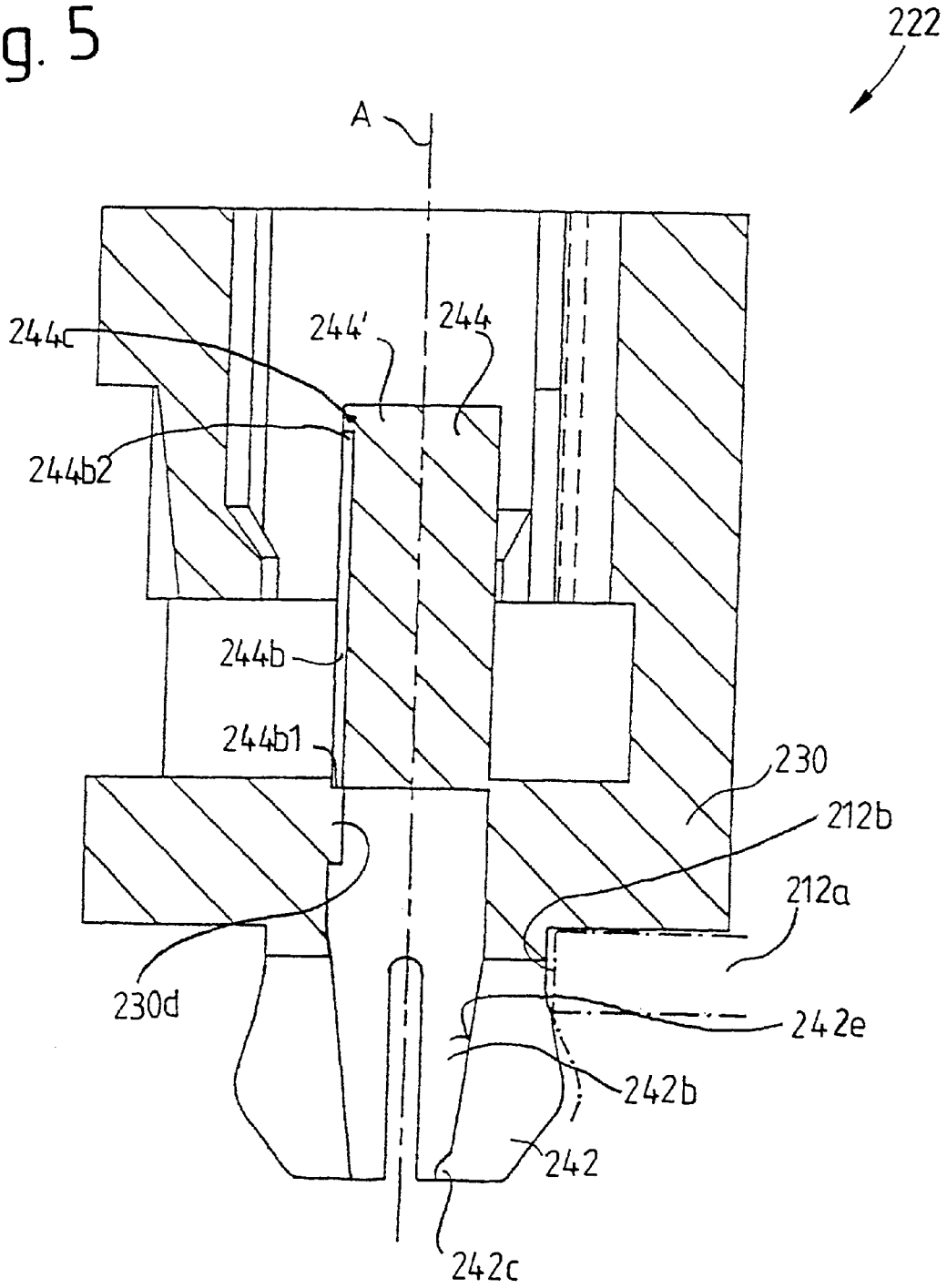
FIG. 5 is an enlarged sectional view of a third embodiment of the axial bearing.

In FIG. 5, similar parts are provided with the same reference numerals as in FIG. 2, but increased by 200. In addition, the axial bearing 222 according to FIG. 5 is described below only in so far as it differs from the axial bearings 22 according to FIG. 2 and 122 according to FIG. 4.

The locking arms 242 of the axial bearing 222 according to FIG. 5 combine the design principles of the locking arms 42 according to FIG. 2 and 142 according to FIG. 4. Thus, first, the locking arms 242 have an outer diameter, in their undeformed position, which is greater than the inner diameter of the aperture 212*b* of the base 212*a* of the upright tube. Consequently, the locking members 242, like the locking members 42 according to FIG. 2, are to a certain extent snapping members which, when introduced into the aperture 212*b*, automatically result in a locking of the axial bearing 242 on the base 212*a* of the upright tube.

Secondly, the inner circumferential surfaces 242*e* of the undeformed locking arms 242 taper from the base disk 230 toward the free ends of the locking arms 242. Consequently, when the securing bolt 244 is inserted into the space 242*b*, the locking arms 242 are moved apart and into their final locking position, shown with dot-and-dash lines in FIG. 5.

In addition, the securing bolt is secured against unintentional dropping out of the space 242*b* between the locking arms 242 first, as in the embodiment according to FIG. 2, by positive fitting by means of retaining shoulders 242*c* and secondly, as in the embodiment according to FIG. 4, by friction fitting caused by the restoring forces of the locking arms 242.

A further alternative is shown in the left-hand half of FIG. 5, making it possible to prevent the securing bolt dropping out of the area 242*b* between the locking arms 242. In this case, the securing bolt 244' is provided with blink grooves 244*b* extending in the direction of the axis A, in other words grooves which, viewed in the direction of the axis A, are open at their ends 242*b*1 nearer the locking arm and closed at their ends 242*b*2 further from the locking arm by an end plate 242*c*. These grooves 244*b* interact with guide ribs 230*d* of the base plate 230. When the securing bolt 244 is completely pressed in, the end plate 244*c* engages the guide ribs 230*d* and so prevents, by positive fitting, unintentional dropping-out of the securing bolt 244.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. A length adjustable column comprising an upright tube with a longitudinal axis and a base plate having an aperture, a piston and cylinder unit received in the upright tube and comprising a first lengthwise end and a second lengthwise end, said first lengthwise end being radially supported by the tube while being axially movable relative thereto, said second lengthwise end being axially fixed relative to said base plate, an axial bearing which is axially fixed to the second lengthwise end, said axial bearing comprising a plurality of locking arms which are received in said aperture of said base plate, said locking arms having a space therebetween, and a securing bolt which is insertable into the space between the locking arms to lock said locking arms in said aperture and secure the axial bearing to the base plate of the upright tube.

2. The length adjustable column as claimed in claim 1 wherein said axial bearing comprises a base disk which rests on the base plate of the upright tube, said securing bolt, prior to insertion between said locking arms, being integrally molded on the base disk.

3. The length adjustable column as claimed in claim 2 wherein the securing bolt is connected to the base disk by at least one frangible connection.

4. The length adjustable column as in claim 3 wherein the frangible connection is a web of material.

5. The length adjustable column as claimed in claim 3 wherein the frangible connection comprises a plurality of connection points between the securing bolt and the base disk.

6. The length-adjustable column as claimed in claim 1, wherein the securing bolt is arranged, in a ready-to-fit state of the axial bearing, substantially completely outside the space between the locking arms.

7. The length-adjustable column as claimed in claim 1, wherein at least one of the locking arms is resiliently engageable to the base plate of the upright tube.

8. The length-adjustable column as claimed in claim 1, wherein the locking arms are radially splayed as a result of the insertion of the securing bolt.

9. The length-adjustable column as claimed in claim 1, wherein the locking arms have at least one axial stop for the securing bolt.

10. The length-adjustable column as claimed in claim 1, wherein the securing bolt has a lengthwise groove having an open end nearer the locking arm and a closed end further from the locking arm in the direction of the longitudinal axis, said axial bearing having a guide rib which engages said groove.

11. The length-adjustable column as claimed in claim 1, wherein the axial bearing comprises a snap-engagement arrangement for axially fixing the second lengthwise end of the piston-and-cylinder unit.

12. The length-adjustable column as claimed in claim 11, wherein the snap-engagement arrangement comprises at least one snapping arm.

13. The length-adjustable column as claimed in claim 12, wherein the at least one snapping arm has a locking surface which engages into a locking recess provided about the circumference of the second lengthwise end.

14. The length-adjustable column as claimed in claim 1, wherein the axial bearing comprises a cage which receives the second lengthwise end in a friction fit.

15. The length-adjustable column as claimed in claim 14, wherein the axial bearing comprises a base disk which rests on the base plate of the upright tube, the cage having a holding ring which is connected to the base disk by at least one connecting web.

16. The length-adjustable column as claimed in claim 15, wherein at least one of said holding ring and said connecting web has an inner surface provided with a vertical bead extending in the axial direction.

17. The length-adjustable column as claimed in claim 15, wherein axial bearing further comprises at least one snapping arm extending from the holding ring toward the base disk.

18. The length-adjustable column as claimed in claim 1, wherein the piston and cylinder unit comprises a piston rod having a free end which forms the second lengthwise end of the piston-and-cylinder unit.

19. The length-adjustable column as claimed in claim 18, wherein the piston rod has a larger diameter than the aperture of the base plate of the upright tube.

20. The length-adjustable column as claimed in claim 1, wherein the axial bearing is injection-molded plastic.

21. A method of installing a piston and cylinder unit in an upright tube of a length adjustable column, said method comprising the steps of providing an upright tube with a longitudinal axis and a base plate having an aperture, providing piston and cylinder unit comprising a first lengthwise end and a second lengthwise end, providing an axial bearing comprising a cage and a plurality of locking arms which are receivable in the aperture of the base plate, said locking arms having a space therebetween, providing a securing bolt above said space which is receivable in said space, plug-fitting the second lengthwise end into the cage of the axial bearing, introducing the piston cylinder unit with the plug-fitted axial bearing into the upright tube with the second lengthwise end foremost, exerting a first axial installing force on the piston and cylinder unit which is sufficient to force the locking arms into the aperture so that the axial bearing rests on the base plate of the upright tube, and exerting a second axial installing force on the piston and cylinder unit which is greater than the first axial installing force and which is sufficient to push the securing bolt into the space between the locking arms.

22. The method of claim 21, wherein the securing bolt is connected to the axial bearing unit by frangible connections prior to exertion of the second axial installing force, the second axial installing force being sufficient break the frangible connections.

* * * * *